US009681727B2

(12) United States Patent
Hynek

(10) Patent No.: US 9,681,727 B2
(45) Date of Patent: Jun. 20, 2017

(54) COSMETIC CLUTCH CARRYING CASE

(71) Applicant: Nikki Hynek Makeup Artistry, L.L.C., Swisher, IA (US)

(72) Inventor: Nicole M. Hynek, Swisher, IA (US)

( * ) Notice: Subject to any disclaimer, the term of this patent is extended or adjusted under 35 U.S.C. 154(b) by 162 days.

(21) Appl. No.: 14/679,579

(22) Filed: Apr. 6, 2015

(65) Prior Publication Data

US 2015/0282588 A1 Oct. 8, 2015

Related U.S. Application Data

(60) Provisional application No. 61/975,822, filed on Apr. 6, 2014.

(51) Int. Cl.
*A45D 33/28* (2006.01)
*A45D 33/00* (2006.01)

(52) U.S. Cl.
CPC ..... *A45D 33/008* (2013.01); *A45D 33/006* (2013.01)

(58) Field of Classification Search
CPC .... A45D 33/00; A45D 33/003; A45D 33/006; A45D 33/008; A45D 33/08; A45D 33/18; A45D 33/24; A45D 33/26; A45D 33/28; A45D 42/16; A45D 2040/22; A45D 2040/222; A45D 2040/223; A45C 11/34; A45C 11/008; A45C 11/24; A45C 13/185; A45C 13/02; A45C 13/005; A45C 15/00; A45C 15/04
See application file for complete search history.

(56) References Cited

U.S. PATENT DOCUMENTS

| | | | | |
|---|---|---|---|---|
| 1,503,979 A | | 8/1924 | Callahan | |
| 1,579,842 A | * | 4/1926 | Rettenmeyer | A45D 33/24 132/296 |
| 1,626,474 A | * | 4/1927 | Morrison | A45D 33/008 132/296 |
| 1,682,534 A | | 8/1928 | Jean | |
| 1,875,245 A | * | 8/1932 | Larson | A45D 33/24 132/303 |
| 2,124,920 A | | 7/1938 | Lambooy | |
| 2,224,995 A | * | 12/1940 | Vogel | A45D 33/008 132/304 |
| 2,437,335 A | | 3/1948 | Shapiro | |
| 5,005,697 A | * | 4/1991 | Jimbo | A45C 13/02 132/294 |
| 6,532,970 B2 | | 3/2003 | Van Phue | |
| 2010/0089793 A1 | | 4/2010 | Plassmeyer | |
| 2011/0073130 A1 | * | 3/2011 | Reynolds | A45C 11/008 132/296 |

(Continued)

FOREIGN PATENT DOCUMENTS

EP 0081901 6/1983

*Primary Examiner* — Rachel Steitz
(74) *Attorney, Agent, or Firm* — Nyemaster Goode, P.C.

(57) ABSTRACT

A cosmetic carrying case having a pair of clamshell members hinged together at a bottom edge thereof such that the members, when closed, form an interior chamber for containing cosmetics materials and, when open, provide access to the interior chamber, divided into two compartments. One of the compartments may include a magnetic surface adapted to removably secure cosmetic pans. A mirror may be pivotally combined with one of the interior compartments. One of the interior compartments may contain elastic straps for retaining cosmetic articles in a fixed position.

10 Claims, 5 Drawing Sheets

(56) References Cited

U.S. PATENT DOCUMENTS

| | | | | |
|---|---|---|---|---|
| 2011/0077061 | A1 | 3/2011 | Danze | |
| 2013/0104927 | A1* | 5/2013 | Hurst | A45D 19/0008 132/221 |
| 2013/0133686 | A1 | 5/2013 | Shteysel | |

* cited by examiner

COSMETIC CLUTCH CARRYING CASE

CROSS REFERENCE TO RELATED APPLICATIONS

This application is based upon U.S. Provisional Application Ser. No. 61/975,822 filed Apr. 6, 2014, the complete disclosure of which is hereby expressly incorporated by this reference.

FIELD OF THE INVENTION

The present invention relates generally to a cosmetic organizer adapted to combine a cosmetic carry case, cosmetic organizer, and mirror. The embodiments of this present invention relate generally to a clutch case, or minaudiere, having an internal folding mirror and a magnetic customizable palette adapted to removably secure cosmetic pans.

BACKGROUND

Women, makeup artists and esthetic professionals use a variety of cosmetic products that are produced in various shapes and sizes. As used herein, the term cosmetic refers to any substance which enhances or promotes the appearance or beauty of the human body. Many cosmetic products are large and bulky and take up a significant amount of space in current cosmetic cases, makeup bags or handbags, while other products are small and easily misplaced amongst items inside of handbags, cosmetic cases or storage drawers. Traditionally, cosmetic cases have been used to organize, secure, transport and store various cosmetic items such as mascara, lipstick, brushes, lip gloss, lip liner, eye liner, tweezers, curlers, powders, blush, eyeshadows, creams, skin-care and other related and similar products. Likewise, conventional clutch cases have served the purpose of transporting personal items such as keys, cell phones, credit cards, driver's licenses, coins and cosmetics. Although there are a myriad of conventional cosmetic organizers and clutch cases currently available, there are none the currently combine the two features of a fashionable rigid frame clutch case accessory with a functional cosmetic organizer.

Generally, clutch cases have an interior compartment that is used to store minimal items such as phones, makeup or toiletries. These items are placed loosely in the clutch case, due to lack of compartments, thus allowing personal items be juggled around causing items to be broken, disorganized and tangled. As a result, disorganized, broken and leaking cosmetics can cause damage to the handbag or storage area and other items contained therein. Difficulties arise when trying to quickly retrieve stowed items from the clutch case. Also, users are forced to carry unnecessary or bulky items such as a mirror, in a separate bag due to lack of useable space. Another common shortcoming of existing clutch cases is the lack of space to be able to fit a plurality of items, namely the inability to fit most cosmetics due to the bulkiness of cosmetic items—namely powder, blush, eye shadows, bronzers and so forth. As a result, designers have taken several conventional approaches to address such shortcomings. One existing approach is a cosmetic organizer with generic compartments to accommodate bulky cosmetic items. Another approach is to provide a clutch case with limited compartments accommodating a minimal range of cosmetics, if any. Yet another type of standard case includes predetermined recesses or compartments that only allow cosmetic products that fit its specific form. These types of devices do not allow for various brands or sizes of cosmetics and the preset locations disallow repositioning or relocating. Lastly, current magnetic palettes work well for adhering cosmetic pans, but there are drawbacks which limit the use of other cosmetics products outside of cosmetic pans, therefore not allowing for other bulk cosmetic items used in congruence with the metal pans, e.g. applicator brushes, sponges, mascaras and such. For example, the use of the eye shadow inside a cosmetic pan cannot be used without an eyeshade applicator, thus forcing the user to tote the applicator along in a separate container. Also, current magnetic palettes in prior art, cannot be transported on their own without being placed inside another objects, such as other makeup cases, for transport.

There is therefore a need for a cosmetic carry case which overcomes these and other deficiencies with the prior art. Prior art does not specifically provide a carry case for cosmetics which, besides being a travel carry case, provides a fold-down mirror for hands-free makeup applications, a customizable magnetic palette for a plurality of cosmetic pans, securing bands for plurality of necessary accessories, and functions as clutch purse and portable travel vanity.

SUMMARY

The various embodiments of the present invention overcome the shortcomings of the prior art by providing a cosmetic organizer in the interior of a clutch case with an attached mirror. The cosmetic clutch case stabilizes the cosmetic contents, permits a plurality of containers of different makeup, permits interchangeable containers and quick access to personal items, minimizes unnecessary cosmetic clutter, permits more cosmetics stored in one place, allows user to apply makeup with the use of attached mirror, permits convenient transporting of personal products and permits a clutch case that can be carried as a standalone fashionable accessory.

The cosmetic clutch case is beneficial for women who travel for work or pleasure because they will use the cosmetic clutch case as an easy and intuitive way to carry their cosmetics. The design allows for more cosmetics to be stored in one lightweight, compact, organized space. Space is important to the frequent traveler. Women who want to take their cosmetics with them for a night out will use the cosmetic clutch case as a practical, yet stylish, way to transport their cosmetics with them. Many women use evening bags or clutch bags currently, thus limiting themselves to just a few cosmetic items to take with them. Many women, with kids or jobs, do their makeup on the run. They would use the cosmetic clutch case as a convenient way to take all of their makeup and applicators for easy application of their makeup on the run. The cosmetic clutch case is a simple way to cut clutter and bulk in home cosmetic storage bins. The cosmetic clutch case allows for streamlined cosmetic organization.

The cosmetic clutch comprises of a clamshell body with two interior compartments, one compartment comprising multiple loop attachments as means for holding articles of different sizes secure and readily accessible in and organized arrangement in the interior the clutch; one compartment having a magnetic surface adapted for releasable attachment of thereon of plurality of cosmetic pans of interchangeable shapes and sizes, and one hinged mirror with spine that lays flat over magnetic chamber and can be folded out into a pyramid formation for use. The exterior construction comprises of pliable material and the said panel being of a generally rectangular clamshell configuration. The exterior pliable material is wrapped around a solid rectangular metal frame apparatus with one spring closure.

The cosmetic clutch contains a clasp that is generally mounted on one side of the metal frame clamshell members and joins together to a retaining member mounted on the other clamshell member. The clasp is significant for securely retaining all interior objects of the interior chambers when clamshell members are joined together in the preferred closed position. To open, the clasp is gently pressed downward and a spring is released from the resilient clasp on one of the clamshell members.

A further object of the cosmetic clutch is to provide a pivoting mirror vanity case that may be folded out into a pyramid position for a hands-free makeup application, or folded into a protective position inside the interior of the case. The mirror also acts as a cover or divider that folds over the magnetized palette thus providing a protective barrier between cosmetics and accessories.

Another object of the cosmetic case is to provide a cosmetic magnetic holder which can host or attach magnetically responsive objects with varying shapes and contours such as cosmetic pans, bobby pins, tweezer, etc. Thus, minimizing the amount of space traditional cosmetics.

Another object is to provide a cosmetic clutch which may be used by many women and professionals to secure additional cosmetics, accessories or personal items when the case is closed.

Yet another object of the present invention is to provide a cosmetic clutch which is easy to use, eliminates the need for several makeup bags, cases or pouches and can be used as a clutch purse.

A still further object is to provide holding means for cosmetic accessories that are used in conjunction with makeup pans.

DETAILED DESCRIPTION

Figure 1:
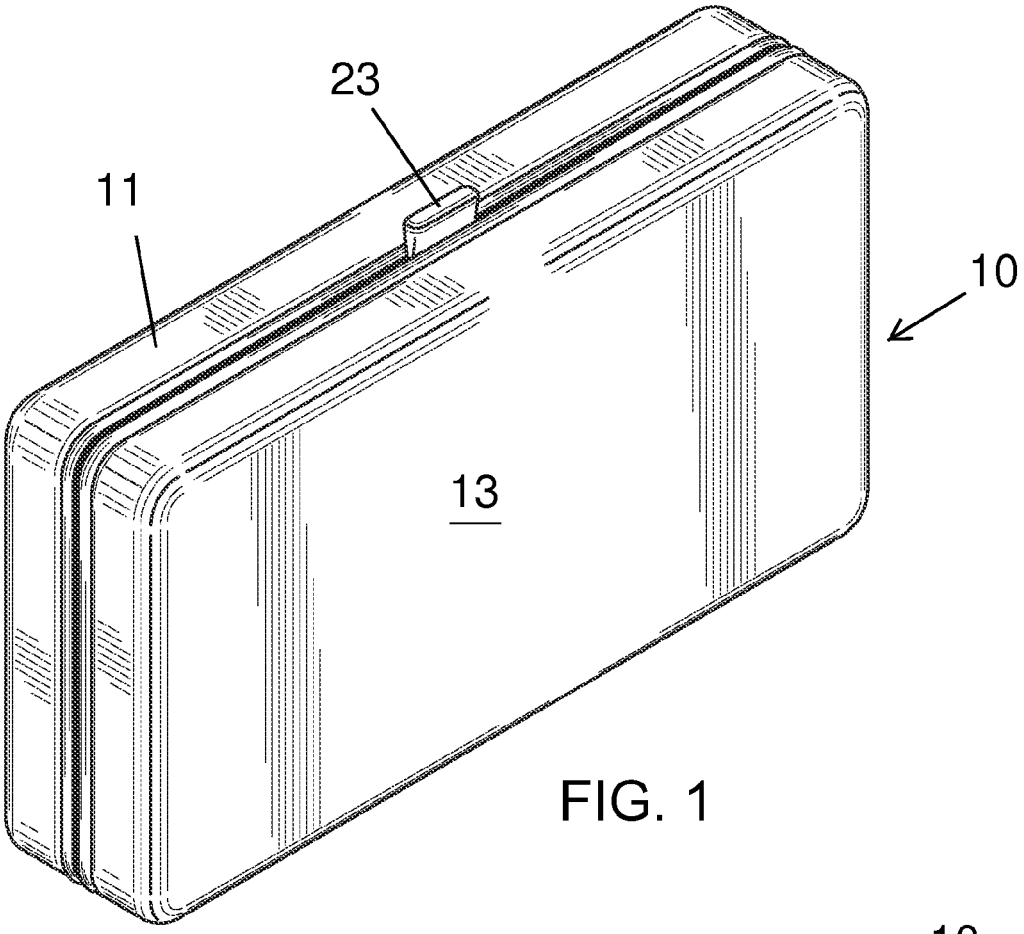
FIG. 1 is a perspective view of an embodiment of the clutch case in the closed position.
Figure 2:
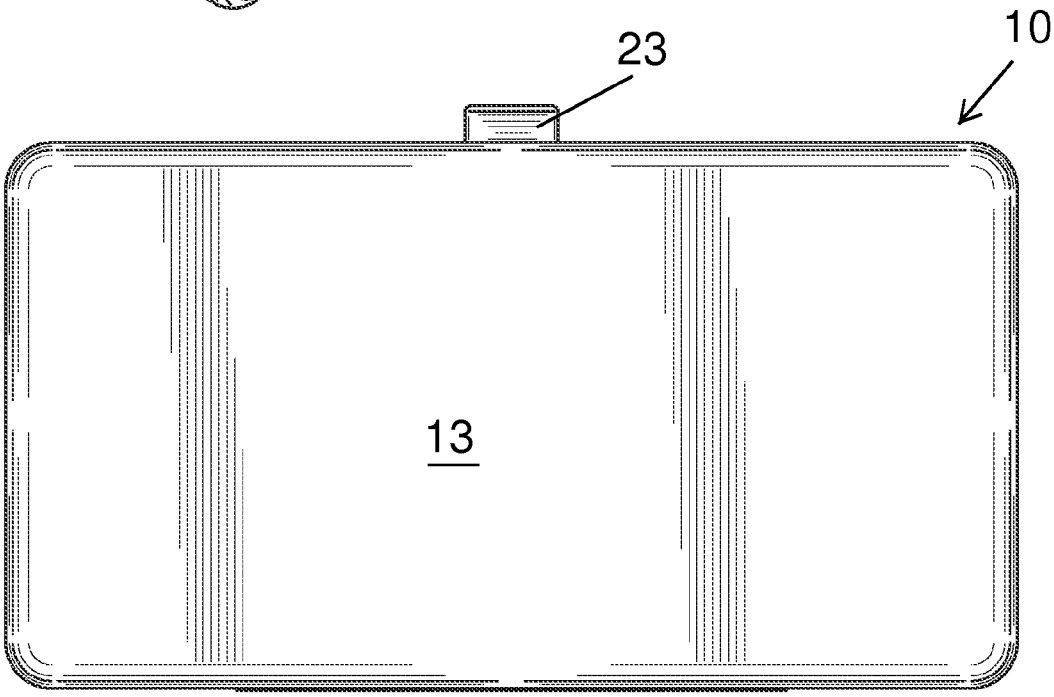
FIG. 2 is a side view of an embodiment in closed position.
Figure 3:
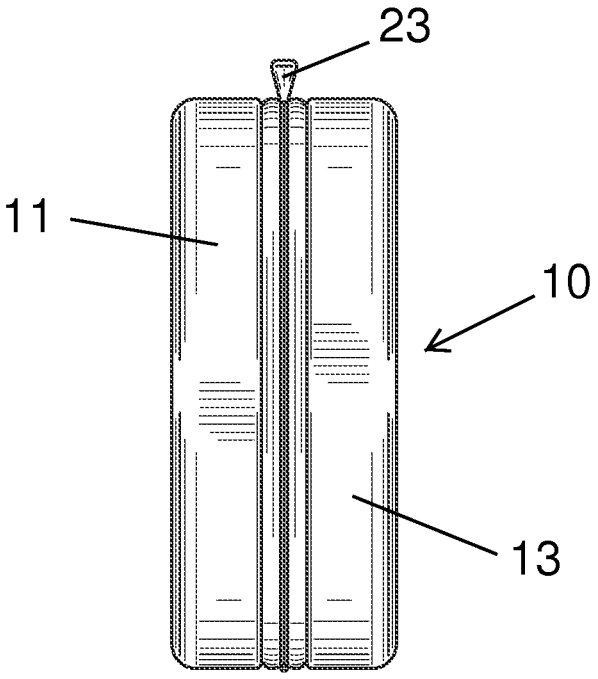
FIG. 3 is an end view of an embodiment in the closed position.
Figure 4:
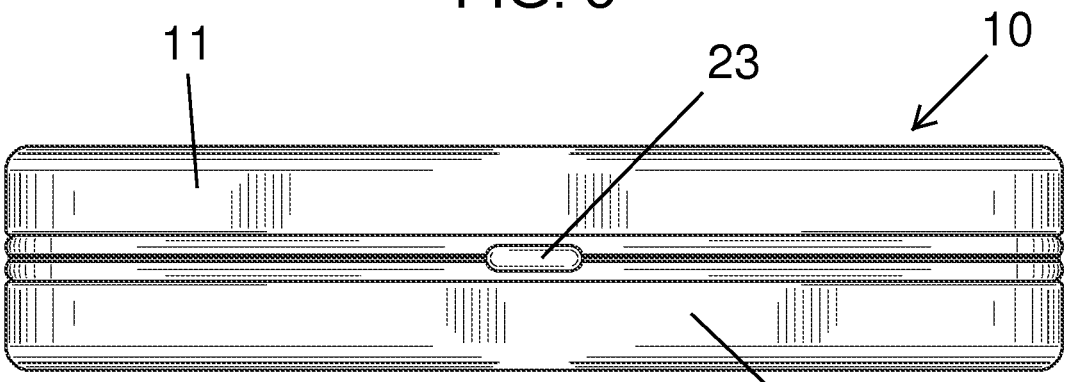
FIG. 4 is a top view of an embodiment in the closed position.
Figure 5:
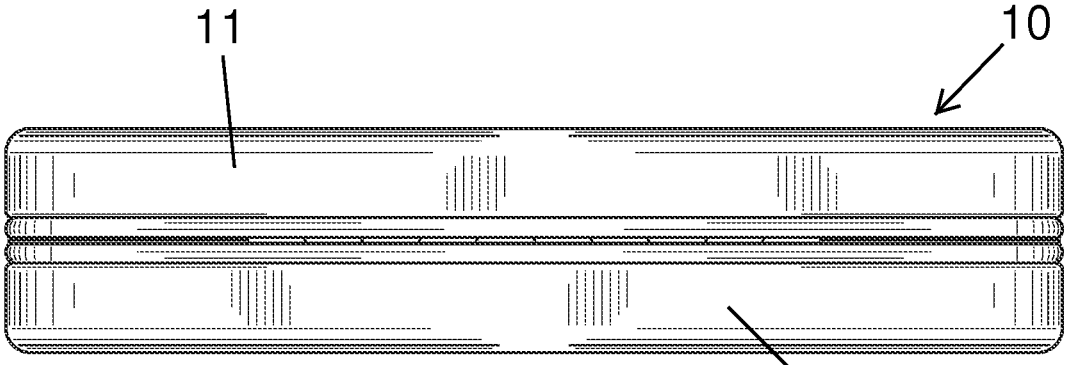
FIG. 5 is a bottom view of an embodiment in the closed position.

The present invention relates to a compact clutch case 10 having at least one interior compartment 12, 14 with a magnetic surface adapted to receive and secure metal cosmetic pans 15. As shown generally in FIGS. 1-6, the device comprises a case 10 having a first portion 11 pivotally combined with a second portion 13 by a hinged attachment. Each portion 11, 13 of the case 10 has an interior compartment 12, 14 (FIG. 6) adapted to store and secure items as described below in more detail. In one embodiment the case is a clamshell clutch style case 10 wherein the first portion 11 and the second portion 13 are mirror images of each other (the same size and shape) when viewed from the outside. The exterior of the case 10 may be constructed of a pliable opaque material (such as leather or synthetic leather) wrapped around a rigid rectangular frame apparatus, which may be made of plastic, cardboard, metal or other suitably rigid materials. The rigid frame helps protect the internal contents, including the make-up pans 15 which are usually no longer in their original container as described below.

The case 10 includes a securing mechanism 23 such as a mechanical clasp to selectively secure the first portion 11 to the second portion 13 when the user desires the case 10 to be held in the closed position. These types of securing mechanisms 23 are generally known in the art for wallets, but not for cosmetic organizers. The securing mechanism 23 provides a way to transport the case 10 in the closed position so that the contents to not spill out. Activation of the securing mechanism 23 releases the secure attachment thereby opening the case 10 when desired by the user for access to the internal compartments 12, 14. As shown in FIGS. 1-4, the securing mechanism 23 is generally combined with the side of the case 10 (which is referred to herein at the top) opposite the hinged attachment.

Figure 7:
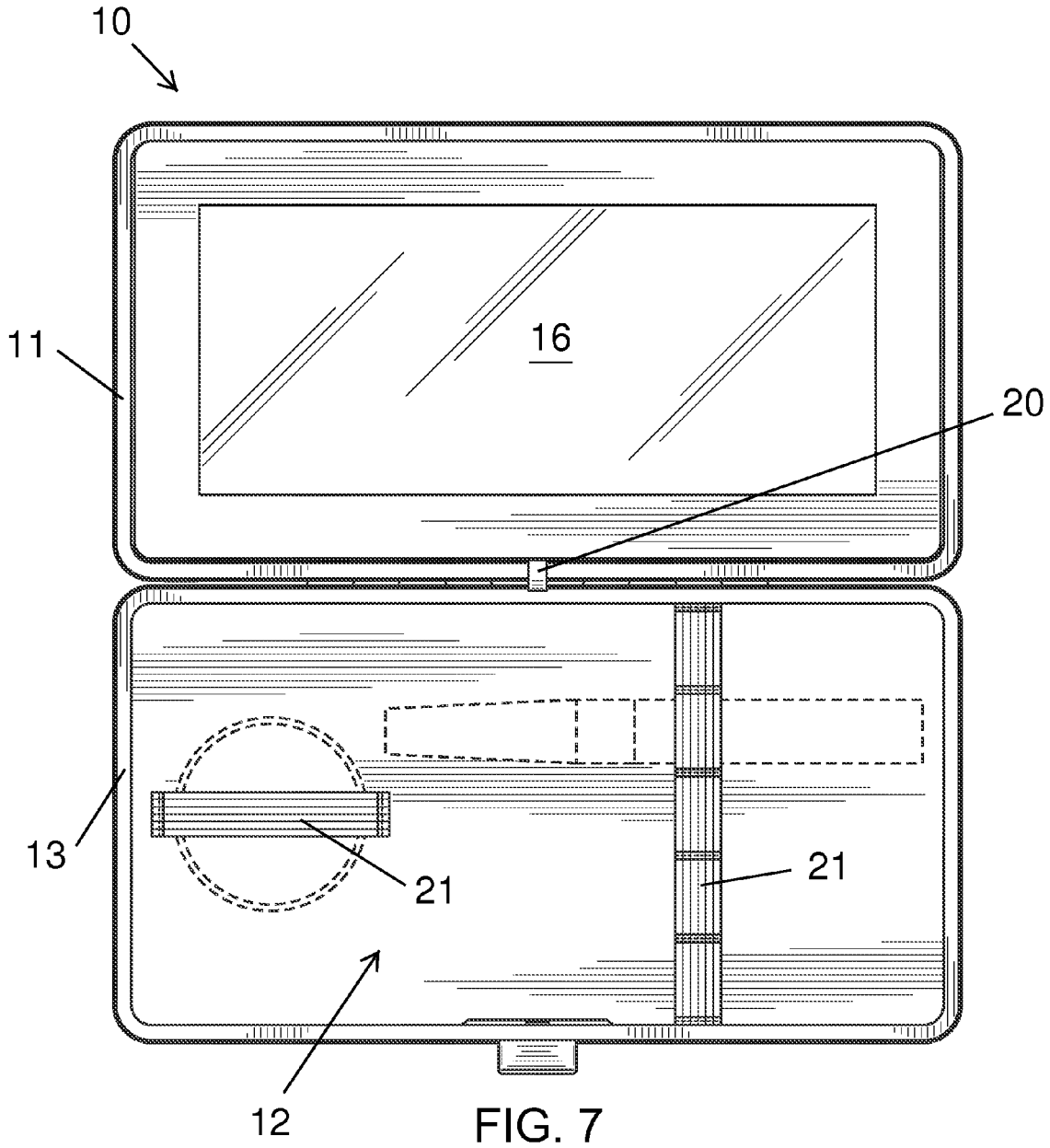
FIG. 7 is a top view of an embodiment in the open position.

The interior compartments 12, 14 may be arranged in any suitable configuration. In one embodiment, one compartment 12, 14 includes slotted openings adapted to receive and secure thin rectangular items such as credit cards and a driver's license. In one embodiment, one compartment 12 has a plurality of securing loops such as elastic bands 21 secured to the case 10 for holding articles such as lipstick secure and readily accessible in an organized arrangement. The elastic bands 21 may be different lengths to accommodate different sized items as shown in FIG. 7. One compartment 14 has a generally flat magnetic surface 7 for releasably securing a plurality of cosmetic pans 15 of interchangeable shapes and sizes. Cosmetic pans, pots, packages or containers, collectively referred to as cosmetic pans 15, are makeup or cosmetic products contained inside of a metal pan. The cosmetic pans 15 comprise magnetic materials such as certain metals which are attracted to the magnetic surface 7. The cosmetic pans 15 are utilized to organize and customize cosmetic products by selectively securing them to a magnetic surface 7 after depotting them or buying them in their original cosmetic pan state. For example, many makeup substances—such as blush, powder, eyeshadow or bronzer—sold for retail are compounded inside of a metal pan 15 that is placed inside of a generally plastic packaging case for the user. Many of these cosmetic pans 15 can be 'depotted' or extracted from their original plastic case through simple method of steadily leveraging the pan 15 from the case therefrom, or by applying heat to the outer plastic case thus softening the bond between the metal pan 15 and its plastic case allowing the pan 15 to be pried out therefrom.

Metal pans 15 having different shapes and sizes can be arranged and adhered to the magnetic surface 7 at the user's discretion. Once a cosmetic pan 15 is placed onto the magnetic surface 7, the magnetic force adheres the cosmetic pan 15 to the surface 7 without further movement until purposefully removed by the user. Furthermore, the cosmetic pans 15 remain in position, with the mirror 16 closed over the magnetic surface 7, and two portions 11, 13 of the case 10 joined together in a closed position. The pans 15 preferably have a height that is shorter than the depth of each portion 11, 13 of the case 10 to help ensure the pans 15 do not interfere with other contents in the case 10 when the case 10 is closed.

Figure 6:
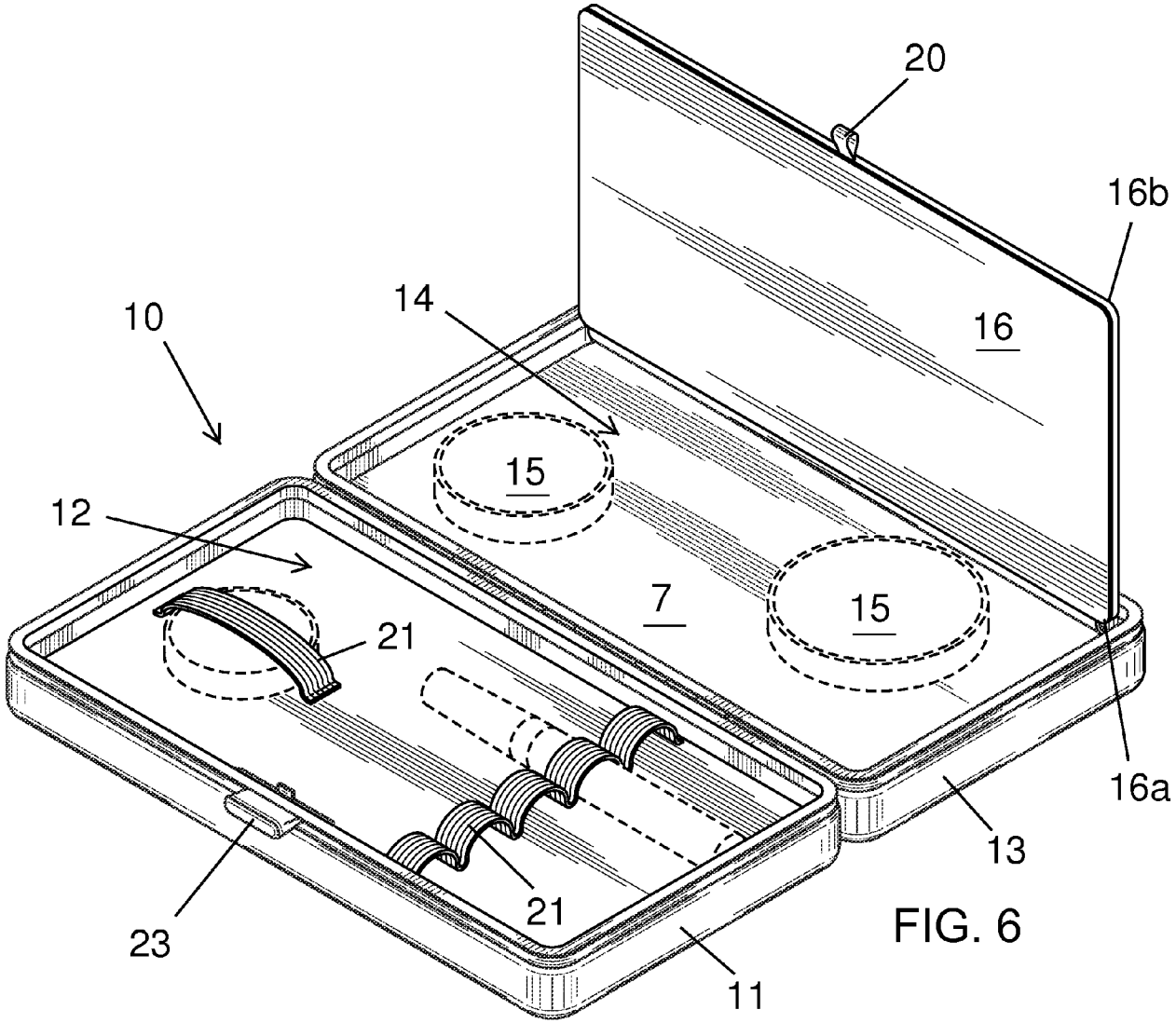
FIG. 6 is a perspective view of an embodiment in the open position.
Figure 8:
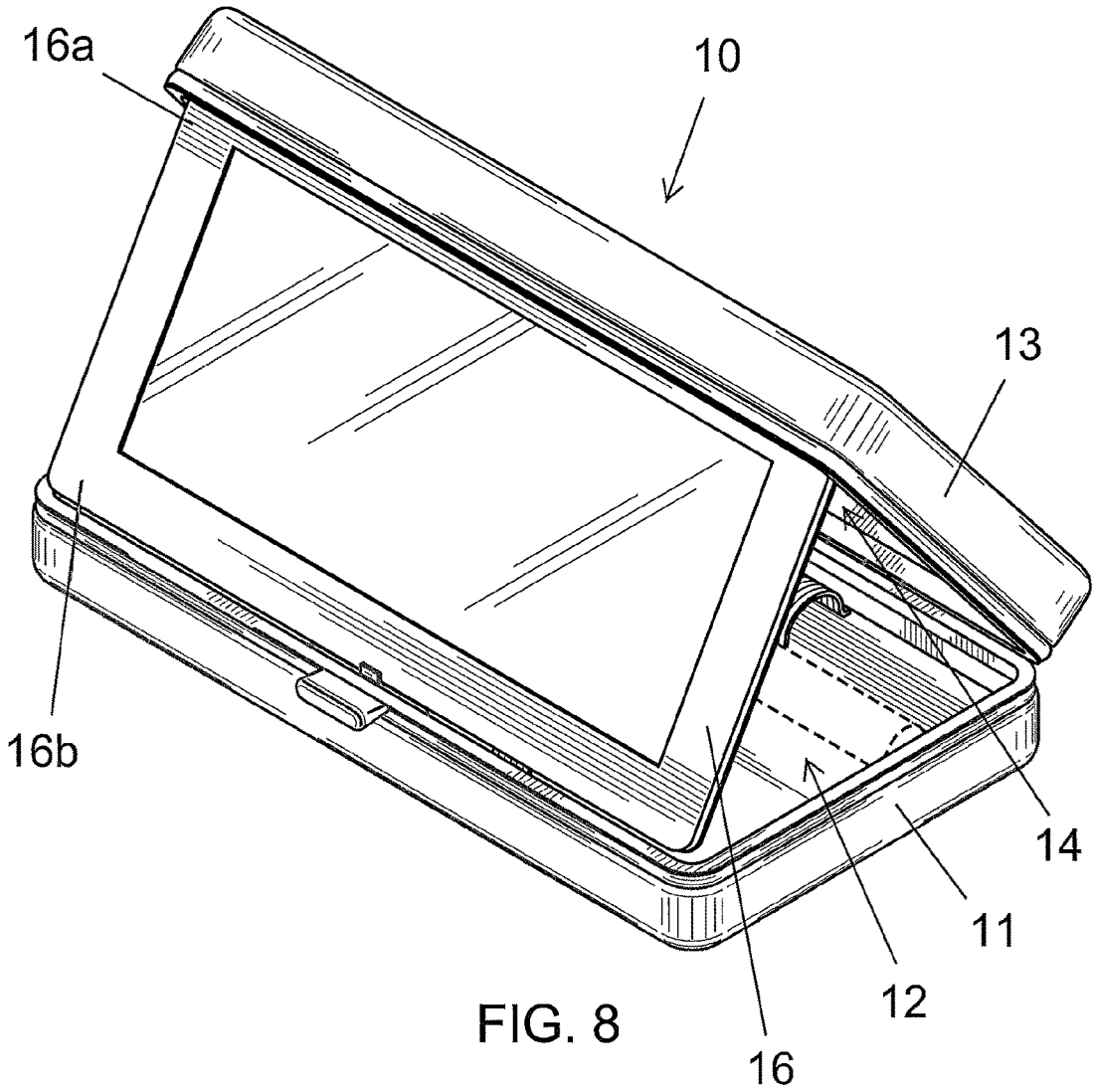
FIG. 8. is a perspective view of an embodiment in the open position.

As shown best in FIGS. 6 and 7 the case may include a mirror 16 pivotally combined with one end of one of the compartments 12, 14. The mirror 16 can pivot between a downward position wherein it lays flat inside one of the compartments 12, 14, and an upward position wherein it extends outward from the compartment as shown in FIGS. 6 and 8. The mirror 16 may be encased in a fabric material, for example pu material, that keeps the mirror secure. The top side of the mirror 16 may contain a fabric ribbon clasp 20 that allows user to rotate and grasp the mirror 16 with ease. In one embodiment the mirror 16 is pivotally combined with the outer edge of the first compartment 14 as shown in FIG. 6. In its downward position the mirror 16 lies flat over the magnetic surface 7 inside one portion 13 of the case 10 to help secure the cosmetic pans 15 and prevents them from being dislodged or moved during carrying, handling, travel or storage.

As shown in FIG. 8, the mirror 16 is pivotally combined with the outer edge of the first compartment 14. The outer edge of the second compartment 12 is adapted to receive the edge of the mirror 16 to create a free-standing triangular-shaped structure. More specifically, the mirror 16 includes a first end 16A and a second end 16B. The first end 16A is pivotally combined with the outer edge of the first compartment 14 by any suitable means. The mirror 16 can be pivoted so that its second end 16B is received by the outer edge of the second compartment 12. The second compartment 12 has a depth thereby allowing the second end 16B of the mirror 16 to be received by the second compartment 12 and positioned against the outer edge of the second compartment 12. The mirror has a length and width which approximates the length and width of one of the compartments 12, 14. Therefore, positioning the second end 16B of the mirror 16 adjacent to the outer edge of the second compartment 12 results in a triangular shaped free standing case. As seen in FIG. 8, the weight from the case portion 13 helps retain the mirror adjacent to the outer edge of the second compartment 12. The free standing case 10 configuration allows a user to look in the outwardly facing mirror 16 while having both hands free to apply makeup.

With its versatile design, the cosmetic clutch case can be easily customized in color, pattern or material for every season to further enhance the esthetic value and appeal.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included with in the scope of the following claims.

What is claimed is as follows:

1. A cosmetic clutch case comprising:

a first portion pivotally combined with a second portion;

a first interior compartment located within the first portion and a second interior compartment located within the second portion, wherein the first interior compartment has an outer portion and the second interior compartment has an outer portion;

a magnetic surface in one of the first and second interior compartments adapted to magnetically secure one or more cosmetic pans;

a mirror portion having a first end pivotally combined with the first interior compartment and a second end, the mirror portion is movable between a first position where the mirror portion is nested within the first interior compartment and a second position where the second end of the mirror portion extends outwardly from the first interior compartment, wherein the second end of the mirror portion is positioned against the second interior compartment when the mirror portion is moved to its second position so that the first portion, second portion, and mirror portion form a free-standing triangular structure.

2. The cosmetic clutch case of claim 1 wherein the first end of the mirror portion is combined with the outer portion of the first interior compartment.

3. The cosmetic clutch case of claim 1 wherein the second end of the mirror portion is adapted to be received by the outer portion of the second interior compartment.

4. The cosmetic clutch case of claim 1 wherein the second interior compartment comprises a plurality of elastic bands adapted to secure items.

5. The cosmetic clutch case of claim 1 further comprising a securing mechanism adapted to selectively secure the first portion to the second portion.

6. The cosmetic clutch case of claim 1 wherein the first portion and second portion are made from a pliable material wrapped around a solid rigid frame.

7. The cosmetic clutch case of claim 1 wherein the mirror portion comprises a mirror partially encased in a fabric material.

8. A cosmetic clutch case comprising:

a first portion pivotally combined with a second portion, wherein the first portion and second portion are made from a pliable material wrapped around a solid rigid frame;

a securing mechanism adapted to selectively secure the first portion to the second portion;

a first interior compartment located within the first portion and a second interior compartment located within the second portion, wherein the first interior compartment has an outer portion opposite the pivotal connection and the second interior compartment has an outer portion;

a magnetic surface in one of the first and second interior compartments adapted to magnetically secure one or more cosmetic pans;

a mirror portion having a first end pivotally combined with the outer portion of the first interior compartment and a second end, the mirror portion is movable between a first position where the mirror portion is nested within the first interior compartment and a second position where the second end of the mirror portion extends outwardly from the first interior compartment, wherein the second end of the mirror portion is positioned against the outer portion of the second interior compartment when the mirror portion is moved to its second position so that the first portion, second portion, and mirror portion form a free-standing triangular structure.

9. The cosmetic clutch case of claim 8 wherein the second interior compartment comprises a plurality of elastic bands adapted to secure items.

10. The cosmetic clutch case of claim 8 wherein the mirror portion comprises a mirror partially encased in a fabric material.

* * * * *